United States Patent [19]

Friess

[11] Patent Number: 4,610,649

[45] Date of Patent: Sep. 9, 1986

[54] METHOD OF MANUFACTURING PLASTIC-COATED PACKAGES TO HOLD LIQUIDS

[75] Inventor: Hans Friess, Linnich, Fed. Rep. of Germany

[73] Assignee: PLK Papier-und Kunstoff Werk Linnich GmbH, Dusseldorf, Fed. Rep. of Germany

[21] Appl. No.: 631,035

[22] Filed: Jul. 16, 1984

Related U.S. Application Data

[63] Continuation-in-part of Ser. No. 315,355, Oct. 26, 1981, abandoned.

[30] Foreign Application Priority Data

Oct. 31, 1980 [DE] Fed. Rep. of Germany ..... 3041050

[51] Int. Cl.[4] ..... B31B 1/88; B31B 3/14; B41F 13/56; B65H 20/00

[52] U.S. Cl. ..... 493/11; 493/55; 493/63; 493/148; 493/324; 226/53

[58] Field of Search ..... 493/55, 63, 148, 324, 493/11, 7, 8, 22, 14, 24, 29; 226/53

[56] References Cited

U.S. PATENT DOCUMENTS

| | | | |
|---|---|---|---|
| 2,321,647 | 6/1943 | Brougham et al. | 493/11 |
| 3,087,393 | 4/1963 | Pottle | 493/11 |
| 3,240,611 | 3/1966 | Williams | 53/456 |
| 3,454,447 | 7/1969 | Corbett et al. | 493/11 |
| 3,484,098 | 12/1969 | Ramsey et al. | 493/11 |
| 3,977,309 | 8/1976 | Gilbert | 493/14 |
| 4,371,364 | 2/1983 | Rausing | 493/7 |

FOREIGN PATENT DOCUMENTS

| | | | |
|---|---|---|---|
| 570419 | 2/1959 | Canada | 493/148 |

*Primary Examiner*—Francis S. Husar
*Assistant Examiner*—William E. Terrell
*Attorney, Agent, or Firm*—Sprung Horn Kramer & Woods

[57] ABSTRACT

In the manufacture of a package used to hold liquids, wherein the package has a perforated or punched-out rip-out opening or a point at which a drinking straw can be inserted, wherein a cardboard web is coated on one or both sides, printed and processed into packages, the improvement which comprises advancing the web past a station prior to coating, and at such station punching or perforating the web at predetermined intervals at predetermined points while simultaneously applying to or impressing into the web register marks, whereby such register marks serve to ensure proper location of the subsequently applied print relative to the punched or perforated points. This differs from prior processes in that it involves perforating the cardboard web prior to both coating and printing, and thus is a simpler process resulting in a superior product.

1 Claim, 3 Drawing Figures

METHOD OF MANUFACTURING PLASTIC-COATED PACKAGES TO HOLD LIQUIDS

Figure 1:
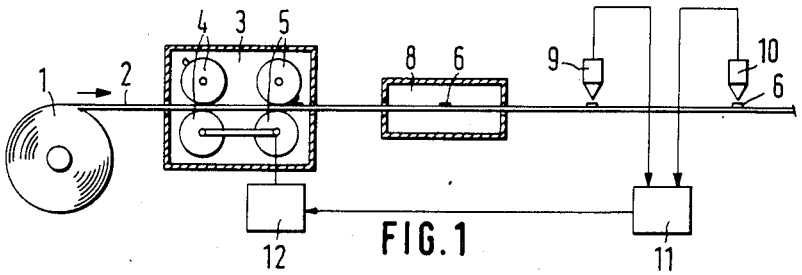

This is a continuation-in-part of Application Ser. No. 315,355, filed Oct. 26, 1981, abandoned.

The invention concerns a method of manufacturing packages that are used to hold liquids, that have a perforated or punched-out rip-out opening or a point at which a drinking straw can be inserted, and that are made of printed and plastic-coated or aluminum-laminated cardboard.

Two methods of manufacturing the printed coated-cardboard packages that have perforations or punched areas capable of being ripped open or pierced with a straw and that are used to hold liquids are known.

In the first method, the cardboard web is first coated and then printed and, in the same stage, punched to weaken it at the point where it is intended to be pierced, which later facilitates ripping the point out or piercing it with a straw when the contents are to be drunk. The cardboard is of course not completely punched through in the manufacturing process because at least the inside layer of plastic must remain integral to ensure that the package stays sealed. This manufacturing method however is not completely satisfactory because it is difficult in practice to punch the point on the cardboard that is to be weakened to precisely the tolerable depth.

In the second method of manufacturing coated-cardboard packages for liquids, the uncoated cardboard is first printed and the point completely perforated or punched through in one stage and the cardboard is then coated and manufactured into the finished package. This known method allows complete perforation or through-punching of the rip-out or piercing point because the subsequently applied coating is not itself perforated or punched through. Still, this second method also has disadvantages:

The working widths of the printing press and of the coating machine must be equivalent, whereas, although it is more economical for the working width of a contemporary coating machine to be as great as possible, the quality of a printing job will often be higher, depending on the job lot, if the working width of the press is smaller. These two objectives can not be achieved together.

Not coating the cardboard until after it has been custom-printed means an additional and time-consuming stage for the job. This can make for problems with rush jobs, which are common in the beverage industry.

When printing is the first stage of the process, taking place that is on the uncoated cardboard, print quality will depend on the surface qualities of the stock, which may vary considerably not only in accordance with supplier but even within one lot.

Both economics and engineering therefore make the first method, in which the cardboard is first coated and then printed and punched, more desirable, even with all the problems involved in punching the stock to just the right depth.

The present invention is intended to combine the advantages of both the first and the second known methods while avoiding the disadvantages of both.

The object of the invention is a method that will provide no problems in punching or perforating the point at which an area of cardboard can be ripped out or perforated with a straw, that will allow an economical width of cardboard to be subsequently coated, and that will then ensure high quality printing with good registration, before the stock proceeds for further processing into the finished package.

To attain this object in accordance with the invention, the web of cardboard travels through a machine in which it is punched or perforated at established intervals at the intended point while register marks are simultaneously applied to or impressed into the web, after which the web is coated on one or both sides and then printed and further processed. Perforating or punching the web of cardboard first and then coating, printing, and finishing it is a departure from state of the art. The supplemental register marks are applied to or impressed into the web while it is being perforated or punched in order to maintain a satisfactory relative register between the printing and the perforation or punched area. Such register marks will enable known sensing devices to keep the printed material in register with the perforated or punched area and thus to control the remaining manufacturing stages.

The register marks can be applied either with a known printing method, in the form of lines for example, or by punching out appropriate shapes, slits for example. The marks can be sensed with known devices, like photocells.

The method of the invention offers the following advantages over known methods:

Perforation or punching can be carried out before, but as part of the same stage as, coating.

The holes or punched out areas will be of continuously high quality and the punching depth variation easy to establish, even up to complete perforation or through-punching.

The method of the invention is more economical because it utilizes the maximal working width of commercially available high-performance coating machines, even when printing and further processing are carried out on narrower machines.

Since any width of the coated but as yet unprinted cardboard web can be stored and printed later with any desired copy when necessary, printing and further processing can be carried out at other sites, with the consequently shorter delivery routes considerably accelerating supply time, while the shops at the other sites will not need the capital-intensive coating machines required for the preliminary stage.

The quality of printing done on a previously coated surface is independent of the surface properties of the uncoated cardboard.

Thus the method of the invention enables coated cardboard webs to be manufactured and stored before an actual order comes in. When an order does come in, the previously coated web can be trimmed to the width of the package blank, printed, manufactured into packages, and, which is especially important in the highly weather-sensitive beverage industry, delivered quickly.

One very practical embodiment of the invention makes it possible to continuously monitor the position of the register marks while a coated web is being printed and to adjust the speed of one or more pairs of rollers when a deviation or shift is detected. This is a relatively simple way to keep the web in register.

Figure 2:
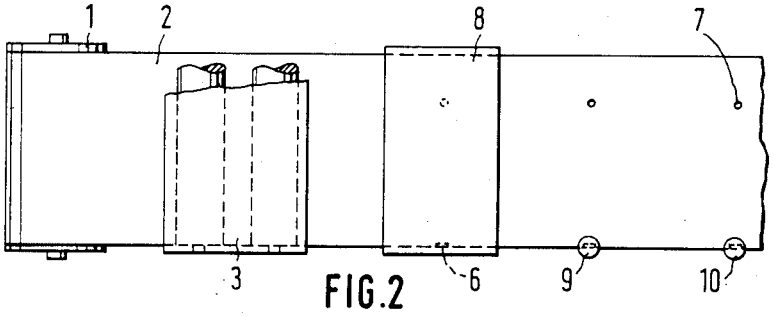
Figure 3:
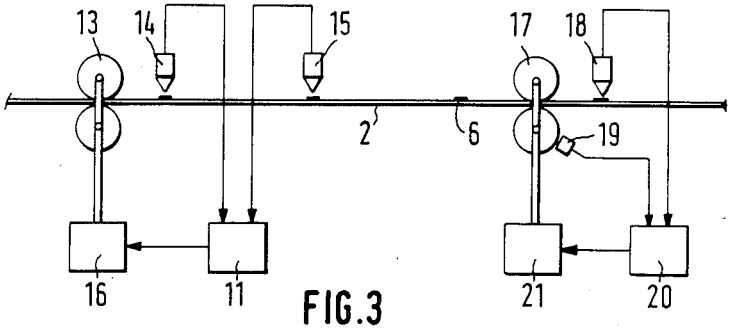

The invention will now be described in detail with reference to the figures, of which FIG. 1 is a diagrammatic side view of a coating machine with an upstream perforating or punching device, FIG. 2 is a top view of the same layout, and FIG. 3 is a side view of an automatically controlled printing system for printing a coated web.

The cardboard web 2 is supplied to the coating machine from a reel 1 and travels first through a station 3 that contains a perforating or punching tool 4 and a printing registration hole punching press 5. Press 5 prints or punches the web with the register marks 6 that will be required for later stages in the process. Although press 5 is preferably a gravure press, it can also be any other known type. Tool 4 and press 5 are powered by a common drive mechanism at station 3 to ensure that the perforated or punched areas 7 and register marks 6 will always be at a constant distance from, and in the same relative position to, each other.

The perforated or punched web 2 with its register marks 6 is then coated with plastic on one or both sides at one or more coating stations 8. It can also be laminated with an additional coating, of aluminum foil for example, at a station not shown in the drawing.

Next, cardboard web 2 travels below two photoelectric sensor heads 9 and 10 that monitor the register marks 6 applied by press 5. The interval between heads 9 and 10 is equal to the nominal distance between perforated or punched areas 7 and can be varied with fine-adjustment screws. If register marks 6, and hence perforated or punched areas 7 as well, are at exactly the nominal distance from each other as they pass under heads 9 and 10, each head will receive a detection signal at exactly the same time. If however the distance between the register marks changes as the result of irregularities in drive mechanism 12 or of variations in the elastic properties or coefficient of friction of the web, etc. the signals will arrive at the heads at different times and a servo amplifier 11 will accelerate or decelerate drive mechanism 12 at station 3 in relation to the other drive mechanisms. The speed of drive mechanism 12 can be regulated with a superimposed direct-current motor or mechanical gearing.

The perforated or punched and coated web 2 can if necessary be trimmed to the desired working width and then stored as long as desired, even at another site, until a definite order for packages is received, at which time it can be printed with the desired customized text and graphics, processed further, and quickly delivered in rolls or as blanks.

Cardboard web 2, once it has been trimmed if necessary and coated with plastic, can alternatively be delivered to the printing press for printing as shown in FIG. 3. In this case it will travel first through a pair 13 of powered calender rollers, second, under two photoelectric detector heads 14 and 15, and then through at least one printing press 17, followed by any desired number of subsequent printing presses as required. Detector heads 14 and 15 are positioned at an interval equal to the nominal distance between register marks 6 and can be finely adjusted. The pulses from heads 14 and 15 are evaluated by a test and servo amplifier 11 that adjusts the variable drive mechanism 16 of roller pair 13, which in turn varies the tension and expansion of web 2 as it travels so that the distance between two subsequent register marks 6 exactly equals the nominal distance. These conditions provide one of the prerequisites for precise print register.

Soon after passing through printing press 17, the web passes under another photoelectric sensor head 18 that, in conjunction with an angle-detection pulse generator 19 mounted on one of the printing cylinders, compares the position of register marks 6 with the angle of the cylinder. When the pulses from sensor head 18 and pulse generator 19 are synchronized, register marks 6 are traveling through press 17 at a constant cylinder angle. This ensures that the printed matter will be in accurate register with marks 6 and with perforated or punched areas 7. When the register marks are out of position, which is indicated by the nonsynchronization of the pulses from sensor head 18 with those from pulse generator 19, test and servo amplifier 20 will rapidly adjust the drive mechanism 21 of printing press 17 until the pulses synchronize again and precise register is restored.

An advantage of the invention is that the plastic coating step precedes creasing of the web, printing the legend to appear ultimately on the outside of the filled containers, forming of the web into blanks and forming the blanks into containers, in contrast with the known systems wherein creasing precedes coating. When creasing precedes coating the coating eliminates sharp crease lines so, when folded, the edges of the container will not be sharp.

Moreover, when the crease lines are covered with a plastic layer, the expansion load during folding will be different for the inner and outer layers. Thus the stress inner layer will attempt to expand again into its former extended position, whereas the stretched outer layer will contract again. This means that both layers will attempt to restore the cardboard, which has been bent at a 90° angle to its original extended position. Since the shape of the package prevents this, this will result in the wall of the package buckling out (augmented by the contents of the package) because of the varying surface tensions in the vicinity of the crease lines, with the effect that the package will be rounded. The desired rectangular package shape will be lost and more space will be needed to stack the packages on shipping pallets and shelves and a visual impact of the package will also suffer for the final consumer since a consumer looking at a buckled package might assume that the contents thereof have spoiled.

It will be understood that the specification and examples are illustrative but not limitative of the present invention and that other embodiments within the spirit and scope of the invention will suggest themselves to those skilled in the art.

I claim:

1. Process for the manufacture of a printed coated cardboard blank for use in forming a package for liquids which package has a perforated or rip-out opening preformed there-through at a predetermined position with respect to the printed message on the package; said process comprising the steps of advancing a cardboard web past a punching or perforating and registration mark applying station;

punching or perforating a portion of said cardboard web and applying registration marks at the station in said cardboard web at a predetermined position with respect to said portion;

keeping substantially constant the distance between successive registration marks by monitoring said distance between successive registration marks downstream from the station, and in response to such distance adjusting the punching or perforating and registration mark applying speed at the station relative to the speed at which the web advances past the station; thereafter coating said cardboard web with a suitable liquid resistant coating before further processing; and thereafter applying the printed message at a predetermined position with respect to said registration marks whereby said printed message is applied in a predetermined position with respect to said punched or perforated portion of said cardboard web, and cutting said printed coated cardboard web into blanks.

* * * * *